US006285352B1

(12) United States Patent
Chen

(10) Patent No.: US 6,285,352 B1
(45) Date of Patent: Sep. 4, 2001

(54) MOVE-IN-COMPANY JOY STICK HAVING A BALL WITH A WEIGHT ATTACHED THAT MAINTAINS VERTICAL POSITION DURING DIFFERENT ORIENTATIONS WHICH FUNCTIONS WITHOUT A LARGE BOTTOM RECEIVING-SEAT

(76) Inventor: Lily Chen, 1F, No. 4, Alley 8, Lane 265, Lian-Cherng Rd., Jong-Her City, Taipei Shine (TW)

( * ) Notice: Subject to any disclaimer, the term of this patent is extended or adjusted under 35 U.S.C. 154(b) by 0 days.

(21) Appl. No.: 09/272,257

(22) Filed: Mar. 19, 1999

(51) Int. Cl.[7] ..... G09G 5/08
(52) U.S. Cl. ..... 345/161
(58) Field of Search ..... 345/156, 157, 345/158, 161, 163; 341/20, 22; 700/83, 84, 85; 463/37, 38; 74/471 XY

(56) References Cited

U.S. PATENT DOCUMENTS 4,587,510 * 5/1986 Kim ..... 463/38
5,528,265 * 6/1996 Harrison ..... 345/158
5,984,785 * 11/1999 Takeda et al. ..... 463/38
6,101,893 * 8/2000 Wergen ..... 345/161
6,121,955 * 9/2000 Liu ..... 345/161

* cited by examiner

*Primary Examiner*—Steven Saras
*Assistant Examiner*—Paul A. Bell
(74) *Attorney, Agent, or Firm*—Dougherty & Troxell

(57) ABSTRACT

A move-in-company style joy stick comprising in a knob thereof a space of suitable size formed by a partition plate, a ball added with a weight, a horizontal grating and a vertical grating are placed in the space. The horizontal and vertical gratings are provided each with a coaxial roller respectively contact the ball in rotation at a position slightly lower than a horizontal central line of the ball. A supporting wheel is provided at a position having an equal angular distance to both the coaxial rollers. When the knob of the joy stick is shaken, a vertical central line of the ball added with the weight is always kept in its vertical position, hence the coaxial rollers are rubbed by the ball in rotation. In this way, the required amount of displacement of the horizontal and vertical gratings being shaken is obtained.

2 Claims, 5 Drawing Sheets

MOVE-IN-COMPANY JOY STICK HAVING A BALL WITH A WEIGHT ATTACHED THAT MAINTAINS VERTICAL POSITION DURING DIFFERENT ORIENTATIONS WHICH FUNCTIONS WITHOUT A LARGE BOTTOM RECEIVING-SEAT

BACKGROUND OF THE INVENTION

1. Field of the invention

The present invention is related to a move-in-company style joy stick, and especially to a move-in-company style joy stick of which internal elements move in company therewith and thereby amount of displacement in operation can be detected. In this way, the whole joy stick can get rid of limitation of the bottom receiving-seat.

2. Description of the Prior Art

A conventional joy stick used for a computer or a television game device mostly is provided at the central position of a bottom receiving-seat. By shaking of the joy stick, internal gratings in the bottom receiving-seat move relatively, in this way, the required amount of displacement in operation can be obtained. However, the joy stick must be combined in operation with the bottom receiving-seat, this makes much inconvenience. In order to make clear of the structure and functions of the conventional joy stick, FIG. 1 is taken as a reference for explanation:

A conventional joy stick has a control rod 10 with a suitable length for holding by a user, the control rod 10 is provided near the central position of a bottom receiving-seat 11. The bottom receiving-seat 11 is provided internally thereof with a horizontal grating 12 and a vertical grating 13 connected operationally with the control rod 10. The horizontal grating 12 and the vertical grating 13 are mounted respectively in a detecting device 14 and a detecting device 15. When the user moves the control rod 10, the end 16 of the control rod 10 moves synchronically the gratings 12 and 13, the detecting devices 14, 15 can thereby detect the required amount of displacement in operation. And the joy stick can get the control function.

The main defect of such a conventional joy stick is that the control rod 10 for moving must be connected to the bottom receiving-seat 11 with a specified size. In order to prevent from instability induced by shaking and moving of the whole joy stick when force is applied in using, the bottom receiving-seat 11 must have quite a large bottom area. This makes the necessity of a larger volume of the bottom receiving-seat 11. And if the user wants to control the joy stick at a farther distance or in a more comfortable posture, the control rod 10 shall be moved together with the bottom receiving-seat 11 as a whole, inconvenience results in such operation.

SUMMARY OF THE INVENTION

The main object of the present invention is to provide a move-in-company style joy stick, wherein, the knob of the move-in-company style joy stick is provided internally with a ball with a suitable size. The ball is added with a weight at the lower portion thereof. A horizontal grating and a vertical grating are provided therein and are provided respectively with a coaxial roller; these rollers contact the ball at the levels slightly lower than the horizontal central line of the ball. The ball with the added weight rubs the rollers in rotation when the joy stick is moved, thereby, the required amount of displacement in operation can be obtained. In this way, the whole joy stick itself is able of detect the required amount of displacement thereof. It can therefore operate independently and is out of limitation of requiring a bottom receiving-seat of large volume.

The present invention will be apparent in the novelty and other features thereof after reading the detailed description of the preferred embodiment thereof in reference to the accompanying drawings.

DETAILED DESCRIPTION OF THE PREFERRED EMBODIMENT

Figure 1:
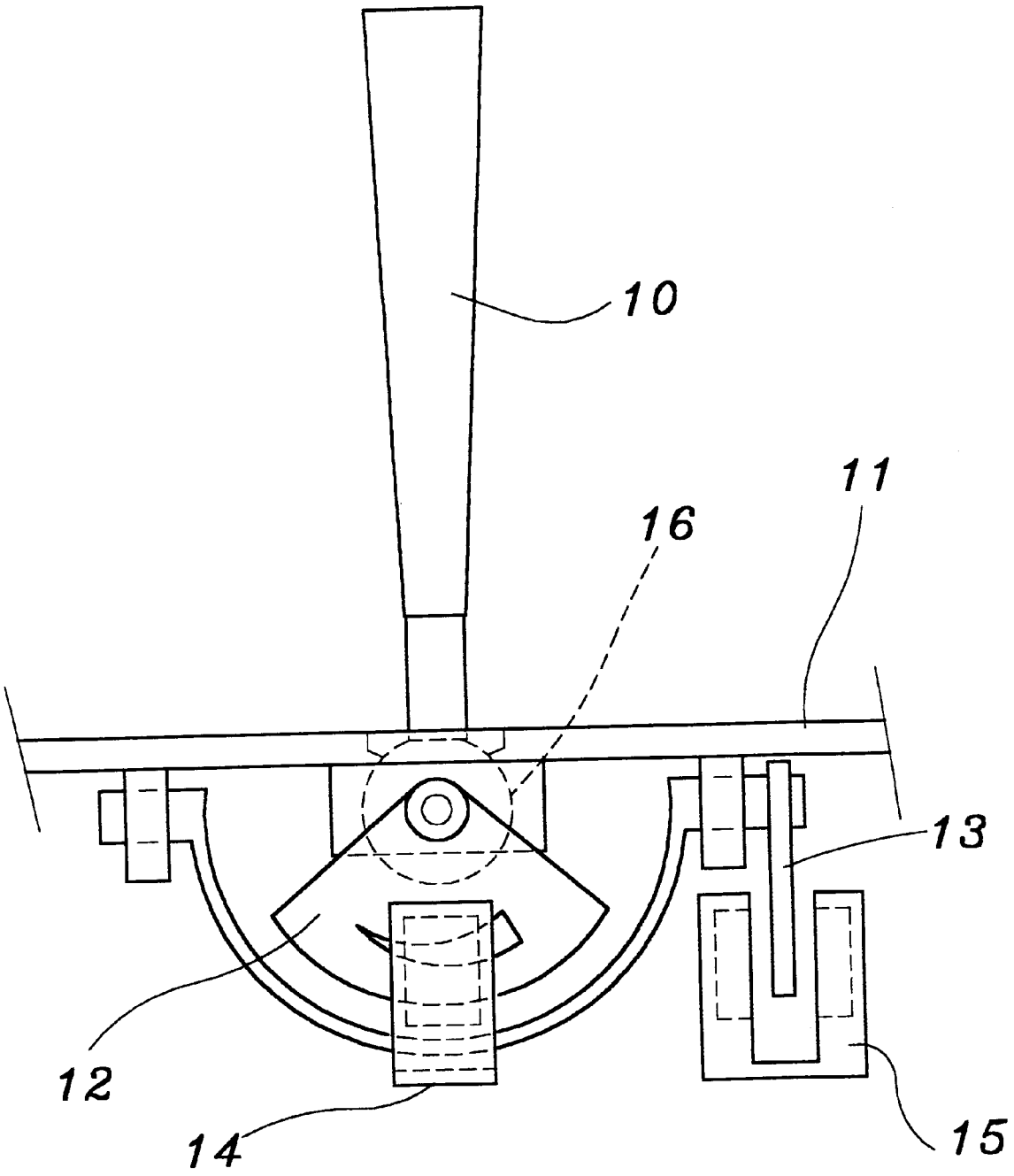
PRIOR ART FIG. 1
FIG. 1 is a schematic view showing the motion in a conventional joy stick.
Figure 2:
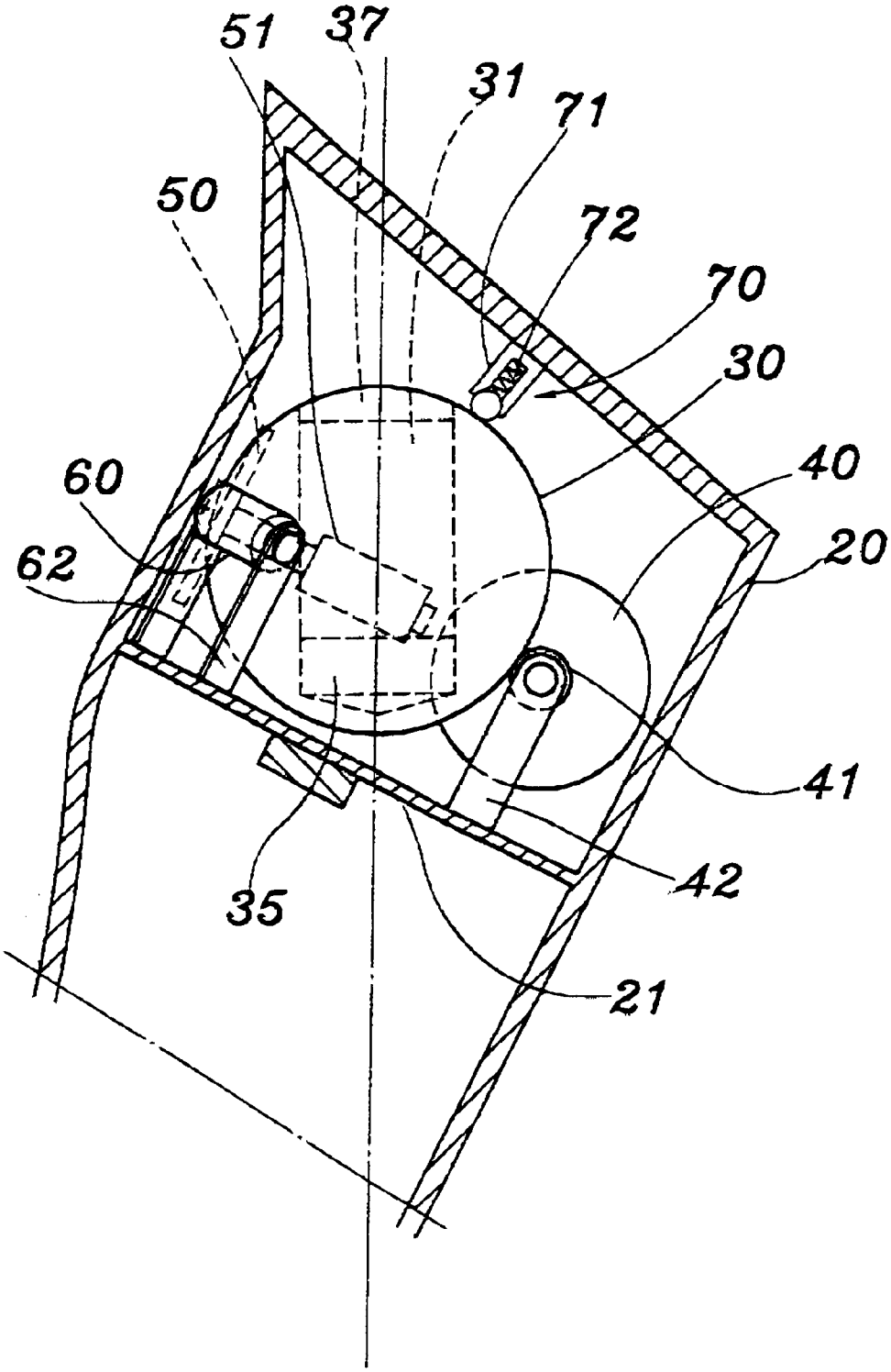
FIG. 2 is a sectional view showing the state of shaking of an embodiment of the present invention.

Referring to FIG. 2, a hollow knob 20 of the joy stick of the present invention is provided therein with a space of suitable size formed by a partition plate 21 for mounting therein a ball 30 added with a weight, and for mounting therein a horizontal grating 40, a vertical grating 50, a supporting wheel 60 and a releasing-proof device 70.

Figure 4:
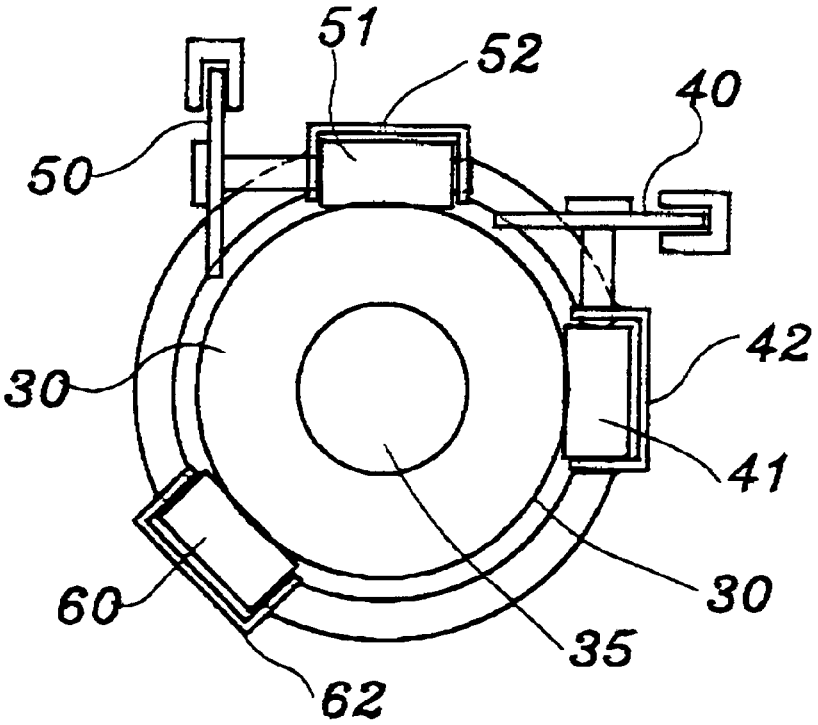
FIG. 4 is a top view showing the internal mechanism of the embodiment of FIG. 2.
Figure 3:
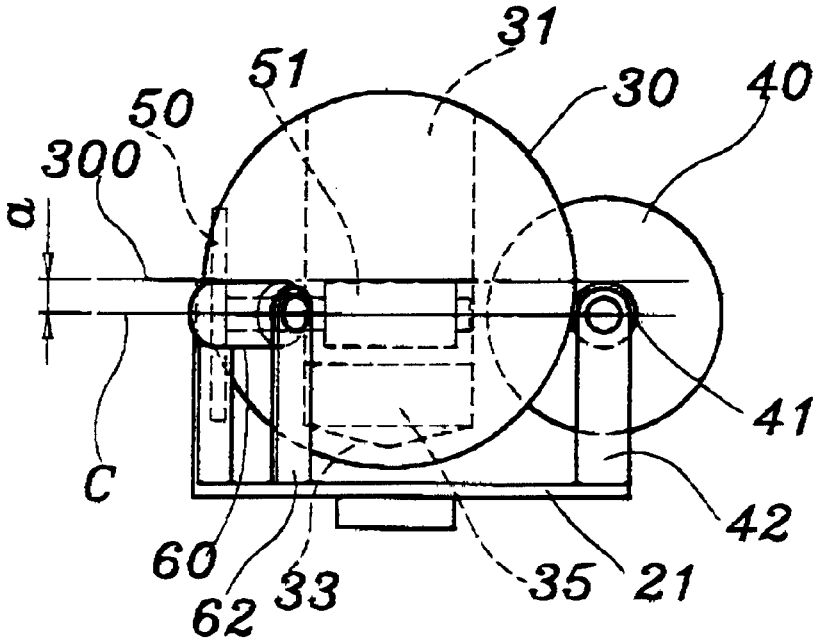
FIG. 3 is a side view showing the internal mechanism of the embodiment of FIG. 2.
Figure 5:
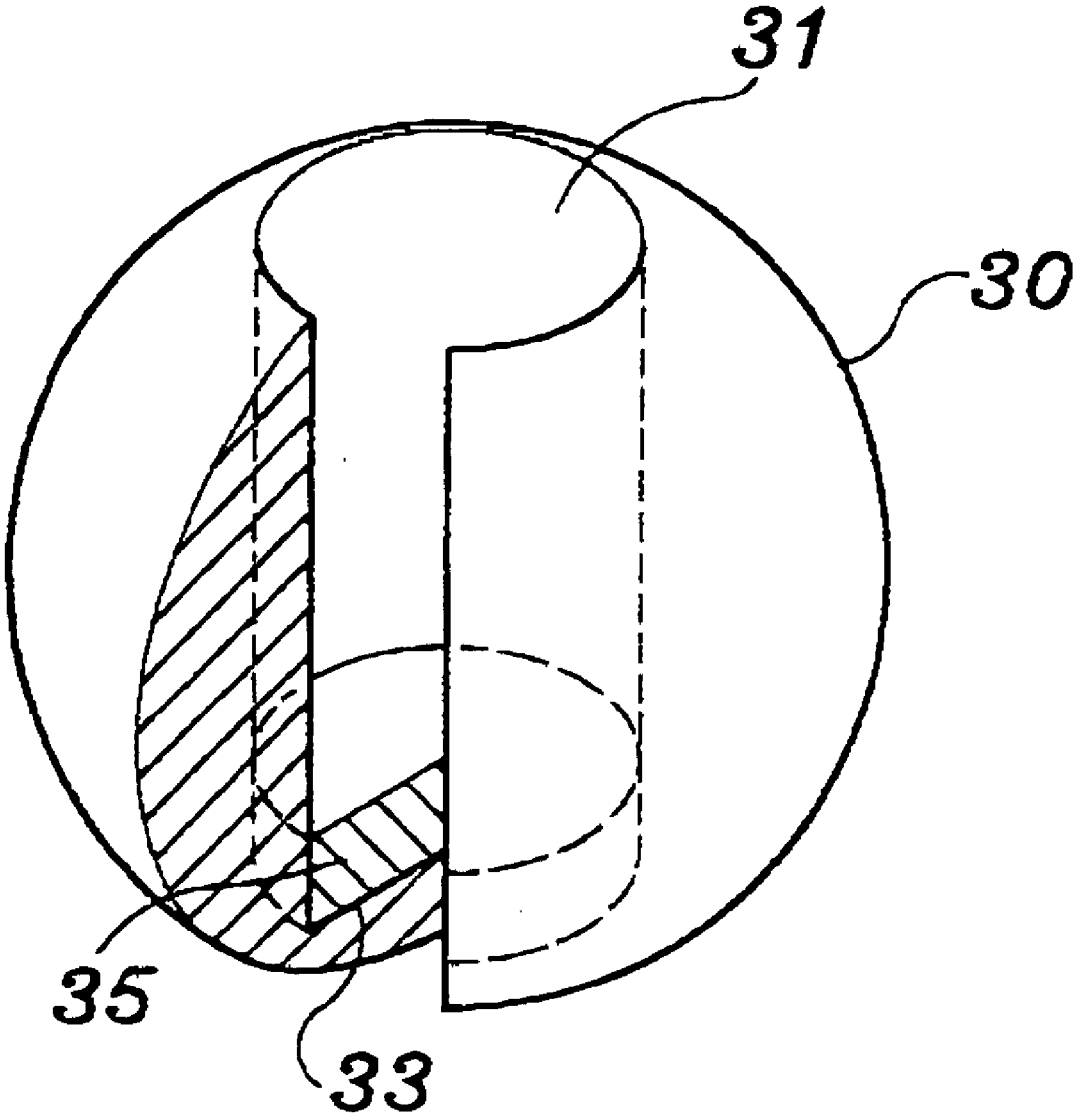
FIG. 5 is a perspective sectional view showing a weight added to the present invention.

Referring together to FIGS. 3 and 4, the horizontal grating 40 and the vertical grating 50 are provided with a coaxial roller 41 and a coaxial roller 51 respectively contacting the ball 30. The ball 30 shown in FIG. 3 is drawn with a horizontal central line 300, while a horizontal central line c of the coaxial roller 41 and of the coaxial roller 51 is preferably at the position a distance "a" slightly lower than the horizontal central line 300. The supporting wheel 60 is preferably provided at a position having an equal angular distance to both the coaxial roller 41 and the coaxial roller 51, and is also on the horizontal central line c of the coaxial roller 41 and the coaxial roller 51. A support 42 and a support 52 respectively of the coaxial roller 41 and the coaxial roller 51 as well as a support 62 of the supporting wheel 60 are all provided on the partition plate 21.

As shown in FIG. 3, 5, in the preferred embodiment of the present invention depicted therein, the ball 30 added with a weight is provided near the bottom thereof with a central through hole 31. Above a bottom surface 33 of the central through hole 31, there is the weight 35 of which the position is preferably lower than the horizontal central line c.

Figure 6:
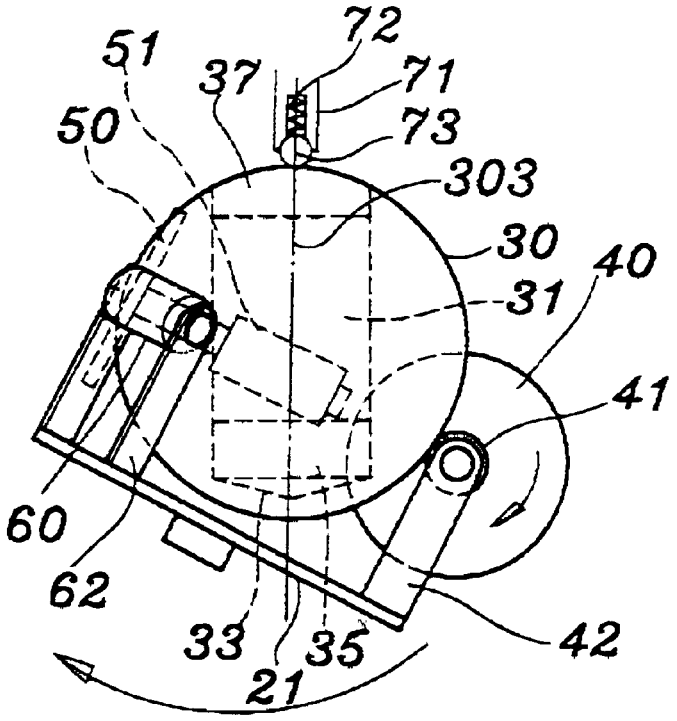
FIG. 6 is a schematic view showing clockwise motion of the embodiment of FIG. 3.
Figure 7:
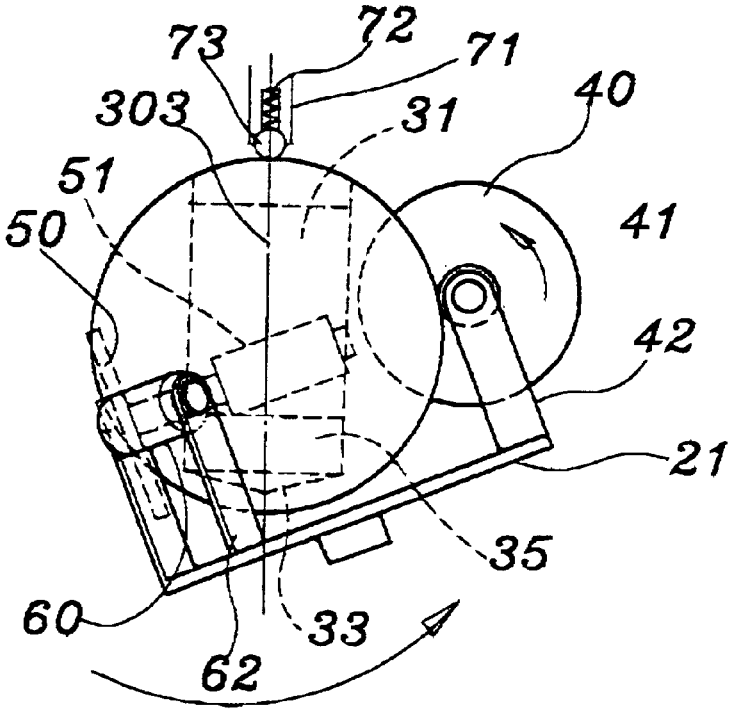
FIG. 7 is a schematic view showing counterclockwise motion of the embodiment of FIG. 3.

Referring together to FIG. 2, 6 and 7, with the above stated structure of joy stick, no matter how the knob 20 of the joy stick moves, the ball 30 provided therein added with the weight 35 has a vertical central line 303 thereof always kept in its vertical position. While the coaxial roller 41 and the coaxial roller 51 displace in pursuance of moving of the knob 20 of the joy stick and are rubbed by the ball 30 in rotation. In this way, the horizontal grating 40 and the vertical grating 50 both are shaken to obtain the required amount of displacement. Thereby, moving or shaking of the joy stick can allow detection of the amount of displacement.

In order to get larger stability in operation of the whole joy stick, the central through hole 31 of the ball 30 is provided on the top thereof with a filler block 37 which is pressed by the releasing-proof device 70. In cooperation with this filler block 37, the releasing-proof device 70 is provided on the top of and integrally with the knob 20 of the joy stick with a cylinder 71 which has a spring 72 therein. An exposed small ball 73 is provided in front of the spring 72 for pressing the filler block 37.

By the fact that the present invention can obtain the required amount of displacement during movement of itself, the joy stick needs only a very small bottom receiving-seat for electric connection. There is no more requirement of a bottom receiving-seat with a large volume; this can largely reduce the volume in manufacturing as well as in packaging. Besides, without limitation of requiring a bottom receiving-seat with a large volume, a user can operate the joy stick in any comfortable posture.

Having thus described my invention, what I claim as new and desire to be secured by letters patent of the united states are:

1. A move-in-company style joy stick, comprising in a knob thereof a space formed by a partition plate, a ball added with a weight, a horizontal grating and a vertical grating are placed in said space, said gratings are provided each with a coaxial roller respectively contact said ball in rotation at a position slightly lower than a horizontal central line of said ball, a supporting wheel is provided at a position having an equal angular distance to both said coaxial rollers;

when said knob of said joy stick is shaken, a vertical central line of said ball added with said weight is always kept in its vertical position, hence said coaxial rollers are rubbed by said ball in rotation, in this way, the required amount of displacement of said horizontal and vertical gratings being shaken is obtained and wherein, said ball added with said weight is provided near the bottom thereof with a central through hole, above a bottom surface of said central through hole, there is said weight of which the position is preferably lower than a horizontal central line of said roller.

2. A move-in-company style joy stick as in claim 1, wherein said central through hole is provided on the top thereof with a filler block above which a releasing-proof device is provided on the top of said knob of said joy stick and wherein, said releasing-proof device is provided on the top of said knob of said joy stick with a cylinder which is integrally connected with said knob and has a spring therein, an exposed small ball is provided in front of said spring.

* * * * *